US005645191A

United States Patent [19]

Neville

[11] Patent Number: 5,645,191

[45] Date of Patent: Jul. 8, 1997

[54] DISPOSABLE SAFETY CUP

[76] Inventor: Lillian Neville, 3751 N. 54th Ave., Hollywood, Fla. 33021

[21] Appl. No.: 559,022

[22] Filed: Nov. 16, 1995

Related U.S. Application Data

[63] Continuation-in-part of Ser. No. 302,492, Nov. 4, 1994, abandoned.

[51] Int. Cl.[6] ..... A47G 19/22

[52] U.S. Cl. ..... 220/717; 215/387; 220/703; 220/705; 220/710; 220/711; 222/572; 239/24; D7/510

[58] Field of Search ..... 220/711–713, 716, 220/717, 705, 707, 710, 703, 254; 215/11.1, 11.6, 386–389; 239/16, 24; 222/572, 567; D7/510, 54, 507

[56] References Cited

U.S. PATENT DOCUMENTS

| | | | |
|---|---|---|---|
| 612,750 | 10/1898 | McDougall | 222/572 X |
| 975,542 | 11/1910 | Letherbury | 222/572 X |
| 2,599,919 | 10/1952 | Hucknall | 239/24 X |
| 3,858,767 | 1/1975 | Borin | 222/572 X |
| 4,573,631 | 3/1986 | Reeves | 220/339 X |
| 4,899,902 | 2/1990 | DeMars | 220/254 |

*Primary Examiner*—Allan N. Shoap
*Assistant Examiner*—Robin A. Hylton
*Attorney, Agent, or Firm*—Robert M. Downey, P.A.

[57] ABSTRACT

A drinking container includes a cup including a bottom, a side wall surrounding an interior of the cup and having an upper peripheral edge, and a U-shaped, elongate trough integrally formed with the side wall and extending upwardly therefrom, beyond the upper peripheral edge. A lid includes a generally circular base with a downwardly extending peripheral flanged lip structured for releasable attachment over the upper peripheral edge of the side wall of the cup and a trough cover integrally formed with the base and extending upwardly therefrom. The trough cover includes an outer, generally convex surface, an inner generally concave surface, and opposite sides having a flanged lip structured for releasable attachment over the side edges of the trough so that when the lid is attached to the cup, the combined trough and trough cover form a drinking spout extending from the cup and terminating at a spout opening.

6 Claims, 1 Drawing Sheet

DISPOSABLE SAFETY CUP

This application is a continuation-in-part application of patent application Ser. No. 08/302,492, now abandoned filed on Nov. 4, 1994.

BACKGROUND OF THE INVENTION

1. Field of the Invention

The present invention relates to a drinking container, and more specifically to a safety drinking container having a cup and a lid which, when attached to the cup, forms a drinking spout.

2. Description of the Related Art

Every day, millions of people purchase coffee at convenience stores, fast-food restaurants, doughnut shops, and the like. In most instances, coffee and other hot beverages purchased at such locations is provided in a styrofoam cup having a removable plastic lid. Many lids are provided with a detachable section so that the hot beverage can be consumed with the lid attached to the cup. Many people prefer to leave the lid on the cup, with the portion of the lid removed, while they are driving or walking in order to prevent the hot beverage from splashing out of the cup. The lid also helps to hold heat in the cup so that the beverage stays hot for a longer time.

It has been found that conventional lids, with removable sections as described above, are not entirely safe because the lid does not prevent the coffee from spilling or splashing through the opening formed by the removed section of the lid. This is especially a problem when the hot beverage is filled close to the top of the cup and the slightest tilt of the cup can cause the beverage to pour from the opening in the lid. Many people have been burned or had their clothing stained as a result of coffee or other hot beverages spilling through the opening of the lid while riding in cars, busses or other vehicles. One reason for this is that the lid, when attached to the cup, gives the illusion that the cup is covered and, thus, the contents within the cup will not spill. Many people then, believing the cup is covered, tend to be more careless when moving the cup than they otherwise would be if the lid was removed. This false sense of security inevitably leads to spills which, if the beverage is hot, can cause serious injury.

In the past, there have been cups developed which include a movable lid with a spout formed on the lid. One example of such a cup is a toddler's drinking cup which is designed to minimize spills if the cup is accidentally knocked on its side. Such a design is not practical with disposable cups, such as polystyrene cups commonly used for coffee and other hot beverages, because it is quite expensive and difficult to form a closed spout on a thin, disposable plastic lid.

Accordingly, there is a need in the related art for a disposable cup, especially suited for containing hot beverages, which includes a cup, removable lid, and an extending drinking spout formed when the lid is attached to the cup, wherein the cup and lid can be economically molded and manufactured for a minimal cost.

SUMMARY OF THE INVENTION

The present invention is directed to a safe drinking container and, more specifically, to a cup having a bottom, a side wall surrounding an interior of the cup, and a U-shaped elongate trough integrally formed with the side wall of the cup and extending upwardly therefrom beyond an upper peripheral edge of the side wall. The drinking container further includes a removable lid having a trough cover integrally formed with a base of the lid and extending upwardly therefrom. The trough cover includes an outer, generally convex surface and an inner, generally concave surface so that when the lid is attached to the cup, the trough cover attaches along side edges of the U-shaped trough to form a drinking spout. The U-shaped structure of the trough and concave inner surface of the trough cover form a fluid passageway from an interior of the cup to an opening at the end of the drinking spout. The lid may further be provided with a hinged flap integrally formed on the end of the trough cover and movable between an open position and closed position to expose the spout opening and cover the spout opening respectively.

With the lid attached to the cup, and the flap opened, the user places the spout opening between his/her lips and, upon tilting the cup to a partially inverted position, the beverage within the interior of the cup flows through the spout, out of the spout opening, and into the user's mouth without spilling.

BRIEF DESCRIPTION OF THE DRAWINGS

For a fuller understanding of the nature of the present invention, reference should be had to the following detailed description taken in connection with the accompanying drawings.

Like reference numerals refer to like parts throughout the several views of the drawings.

DETAILED DESCRIPTION OF THE PREFERRED EMBODIMENT

Figure 1:
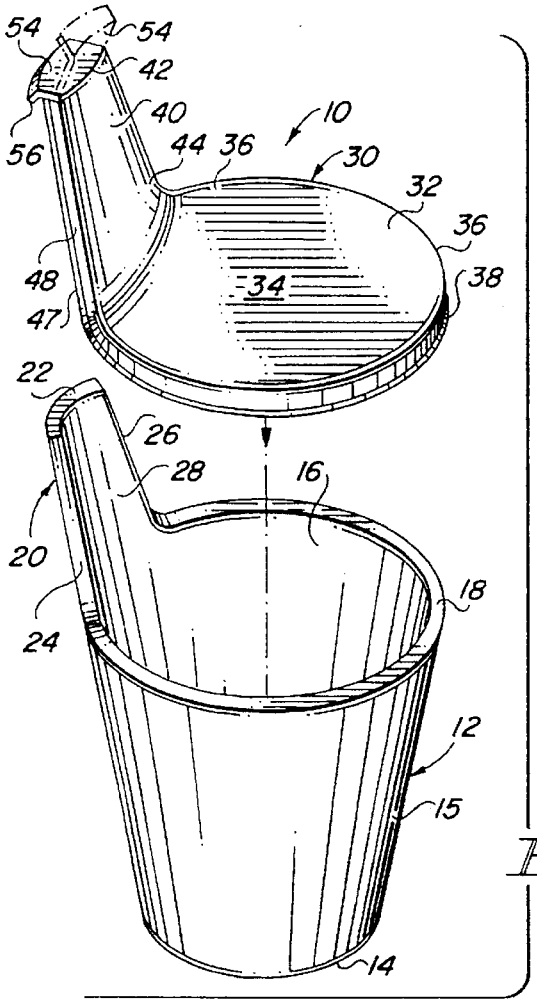
FIG. 1 is an exploded perspective view of the drinking container of the present invention.
Figure 2:
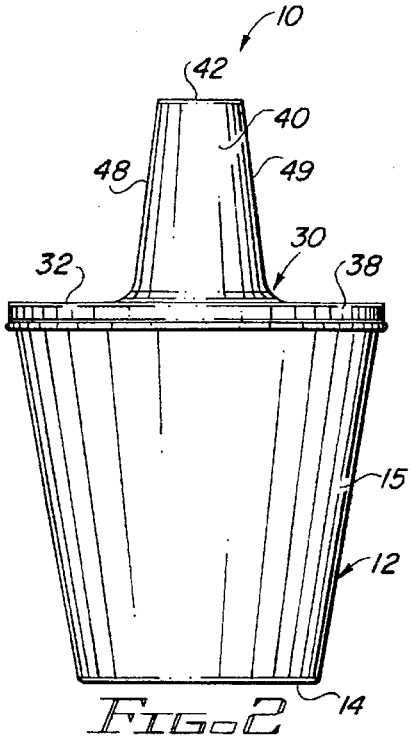
FIG. 2 is a front elevation showing the cup and trough cover of the lid.
Figure 3:
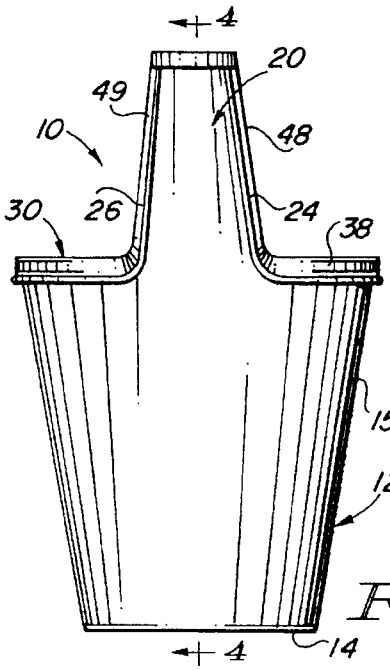
FIG. 3 is a rear elevation showing the cup and integrally formed trough with the lid secured to the cup.
Figure 4:
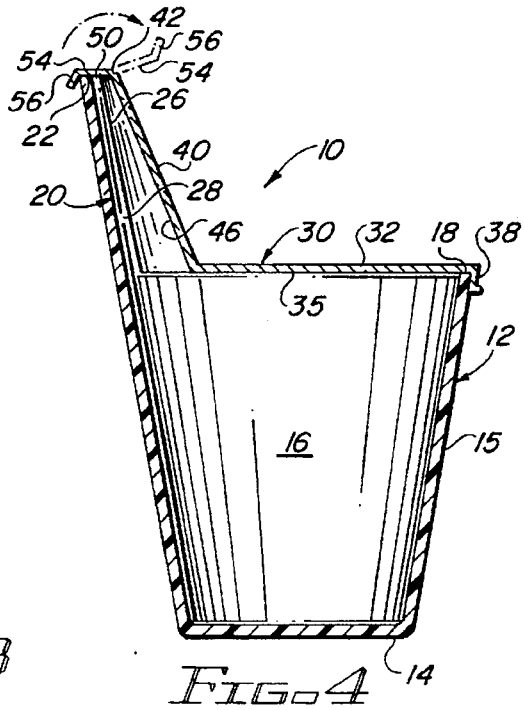
FIG. 4 is a side elevation, in section, taken along the line 4—4 of FIG. 3.

Referring to the several views of the drawings, there is illustrated the disposable safety cup of the present invention, generally indicated as 10. The invention includes a cup 12, preferably formed of polystyrene or like insulative material which is easily molded in an injection process. The cup 12 includes a bottom 14 and a surrounding side wall structure 15 disposed in surrounding relation to an interior 16 of the cup 12. An upper peripheral edge 18 of the side wall 15 surrounds an open top of the cup 12.

The cup 12 is further provided with a U-shaped elongate trough 20 integrally formed with the side wall 15 of the cup and extending upwardly from the peripheral edge 18 and terminating at a top distal edge 22. The trough 20 has opposite side edges 24, 26 extending from the upper peripheral edge 18 of the cup to the top distal edge 22 of the trough. An inner concave surface 28 of the trough 20 extends from the interior 16 of the cup 12 along the length of the trough 20 to the top distal edge 22 thereof. The inner concave surface 28 is specifically structured to define a channel to direct liquid flow therealong from the interior 16 of the cup 12 to the top distal edge 22 when the cup 12 is tilted from an upright position.

A lid 30 attaches to the open top of the cup 12 and trough 20 in covering relation to the interior 16 and concave inner surface 28. The lid 30 includes a generally circular base 32 having a top surface 34, a bottom surface 35, and an outer peripheral zone 36 about the periphery of the base 32. A flanged lip 38 is integrally formed with the base 32 of the lid 30, about the outer peripheral zone 36, and extends downwardly therefrom. The flanged lip 38 is specifically structured for releasable attachment over the upper peripheral edge 18 of the wall 15 of the cup 12.

The lid 30 further includes a trough cover 40 integrally formed with the base 32 and extending upwardly from the outer peripheral zone 36 to a top end 42. The trough cover 40 includes an outer generally convex surface 44, an inner generally concave surface 46, and opposite sides 48, 49. The opposite sides 48, 49 include a flanged lip 47 specifically structured for releasable attachment over the opposite side edges 24, 26 of the trough 20. When the lid 30 is attached to the cup 12, the combined trough and trough cover define a drinking spout extending from the top of the cup 12. Together, the inner concave surface 46 of the trough cover and concave surface 28 of the trough 20 form a hollow fluid passage from the cup interior 16 to an open end 50 of the spout adjacent the top distal edge 22 and top end 42 of the trough 20 and trough cover 40, respectively.

In a preferred embodiment, the lid 30 may be provided with a hinged flap 54 integrally formed along the top end 42 of the trough cover 40 to form a living hinge therealong so that the flap 54 is movable between an open position, exposing the spout opening 50, and a closed position in covering relation to the spout opening 50. A downwardly extending tab 56 formed on the flap 54 defines releasable securing means structured to grasp the top distal edge 22 of the trough 20 to keep the flap 54 in the closed position covering the spout opening 50.

While the instant invention has been described and illustrated in what is considered to be a preferred and practical embodiment thereof, it is recognized that departures may be made within the spirit and scope of the invention, as set forth in the following claims, the limitations of which shall be determined within the doctrine of equivalents.

Now that the invention has been described,

What is claimed is:

1. A drinking container comprising:

a cup including a bottom, a side wall surrounding an interior of said cup and having an upper peripheral edge, and a U-shaped elongate trough integrally formed with said surrounding side wall and extending upwardly therefrom beyond said upper peripheral edge and terminating at a distal edge, said trough including opposite side edges extending from said upper peripheral edge to said distal edge and an inner concave surface between said opposite side edges and extending from within said interior of said cup to said distal edge, a lid including a generally circular base having a top surface, a bottom surface, and an outer peripheral zone including a downwardly extending peripheral flanged lip structured for releasable attachment over said upper peripheral edge of said side wall, said lid further including a trough cover integrally formed with said base and extending upwardly from said outer peripheral zone to a top end, said trough cover including an outer convex surface, an inner concave surface, and opposite sides each including a flanged lip structured for releasable attachment over said opposite side edges of said trough, and said combined trough and said trough cover, when attached, defining a drinking spout in fluid flow communication with said interior of said cup, and said distal edge and said top end forming a drinking spout opening.

2. A drinking container as set forth in claim 1 wherein said lid further includes a hinged flap integrally formed along said top end of said trough cover, said flap being movable between an open position, to expose said spout opening, and a closed position in covering relation to said spout opening.

3. A drinking container as set forth in claim 2 wherein said flap includes means thereon to releasably secure said flap in said closed position.

4. A drinking container as set forth in claim 3 wherein said cup is formed of polystyrene.

5. A drinking container as set forth in claim 3 wherein said lid is formed of plastic.

6. A drinking container as set forth in claim 3 wherein said cup is formed of plastic.

* * * * *